US008096298B2

(12) United States Patent
Shieh

(10) Patent No.: US 8,096,298 B2
(45) Date of Patent: Jan. 17, 2012

(54) SNORKEL

(76) Inventor: Steve Shieh, Danshui Town (TW)

( * ) Notice: Subject to any disclaimer, the term of this patent is extended or adjusted under 35 U.S.C. 154(b) by 0 days.

(21) Appl. No.: 12/203,721

(22) Filed: Sep. 3, 2008

(65) Prior Publication Data

US 2011/0168173 A1 Jul. 14, 2011

(51) Int. Cl.
*A61F 6/06* (2006.01)

(52) U.S. Cl. ..... 128/201.26; 128/201.07; 128/207.14; 128/200.24

(58) Field of Classification Search ..... 128/201.26, 128/201.27, 207.14, 200.24, 200.26
See application file for complete search history.

(56) References Cited

U.S. PATENT DOCUMENTS 6,915,800 B2 * 7/2005 Hwang ..... 128/201.11
7,089,929 B1 * 8/2006 Feng ..... 128/201.11
7,621,268 B2 * 11/2009 Junck ..... 128/201.27
7,634,997 B2 * 12/2009 Shiue ..... 128/201.11
7,909,030 B2 * 3/2011 Christianson ..... 128/201.11

* cited by examiner

*Primary Examiner* — Jerome w Donnelly
(74) *Attorney, Agent, or Firm* — Muncy, Geissler, Olds & Lowe, PLLC

(57) ABSTRACT

A snorkel for users floating or skin diving on the sea is disclosed. The snorkel includes an inlet tube, a mouthpiece chamber and a mouthpiece. A comber impermeable cap with a first valve is arranged on a top end of the inlet tube while a bottom end of the inlet tube is sleeved with an inlet end of the mouthpiece chamber. A baffle is disposed inside the mouthpiece chamber so as to form an upper chamber and a lower chamber. A second valve is arranged on the inlet end of the mouthpiece chamber so as to make air flow into the mouthpiece chamber or the upper chamber. At least one third valve is arranged on a corresponding outlet end so that air or water is exhausted from the mouthpiece chamber. A mouthpiece is sleeved on top surface of the mouthpiece chamber. The exhaled waste air is unable to enter the inlet tube and is exhausted only through the third valve. Therefore, users can breathe in/out easily without water inhalation or hypoxia.

8 Claims, 10 Drawing Sheets

SNORKEL

BACKGROUND OF THE INVENTION

The present invention relates to a snorkel that is used while people floating or skin diving on the sea, especially to a snorkel that people can breathe easily without inhaling water or hypoxia and such snorkel is with higher safety.

There are various designs of snorkels used in general skin diving. Conventional snorkels are formed by a curved tube and a mouthpiece arranged on a bottom end of the curved tube. Users (Swimmers) take a breath in/out through the curved tube. During breathing processes, the exhaled waste air is released through the snorkel. While the waste air not being completely released and the user breathing in again, the waste air is breathed into the user's body again to form a dead space so that the user can't have fresh air and have hypoxia. Moreover, water in the snorkel is released by breathing out. Once the water is not discharged in time, the swimmer is easy to inhale water. As to the water inhalation problem, there are various type of snorkels such as water-free snorkel, ping pong ball type and lever ball type snorkel (please refer from P62 to P64 in World Underwater Federation Sports Committee Manual written by Karl-Heinz Kerll). A valve that present water from flowing into the snorkel is arranged on top of the snorkel. However, objects drifting on the water such as leaves may stock the inlet so that the water flows into the snorkel and the swimmer inhales water while taking a breath. Instead of reducing water inhalation, the accidents increase. After 1981, there are a lot of famous institutes oppose to use such snorkels. The snorkels available now can't improve above problems. Thus there us a need to provide a snorkel that improves shortcomings of conventional snorkels such as dead cavity and water inhalation.

SUMMARY OF THE INVENTION

Therefore it is a primary object of the present invention to provide a snorkel that consists of an inlet tube, a mouthpiece chamber and a mouthpiece. A comber impermeable cap with a one-way first valve is arranged on a top end of the inlet tube while a bottom end of the inlet tube is sleeved with an inlet end of the mouthpiece chamber. The inlet end of the mouthpiece chamber is connected with the inlet tube while the other end thereof is an outlet end for releasing air or water. A baffle is disposed inside the mouthpiece chamber so as to form an upper chamber and a lower chamber. A round opening is arranged on top surface of the mouthpiece chamber to be assembled with the mouthpiece. At least one one-way second valve is arranged on an inner side of the inlet end so that air or water flows into the upper chamber in one direction. At least one one-way third valve is disposed on an inner side of the outlet end so that air or water flows into the mouthpiece chamber in one direction. Thereby, the comber impermeable cap prevents water from moving into the snorkel through the inlet tube and fresh air enters the inlet tube so that inlet tube is filled with fresh air and the user can breath easily while exhaled air is exhausted through the third valve of the outlet end and is unable entering into the inlet tube through the second valve on the inlet end. Thus the exhaled air will not stay in the snorkel and the user will not have hypoxia or carbon dioxide intoxication due to no fresh air when the user is breathing rapidly and repeatedly. Furthermore, a little water inside the mouthpiece chamber flows down to the lower chamber along the baffle and is forced by exhaled air to be released through the third valve. Thus the user breaths more easily without water inhalation or hypoxia and the snorkel is used with higher safety.

It is another object of the present invention to provide a snorkel that includes a one-way first valve disposed in the comber impermeable cap. While breathing in, the external air enters into the snorkel and flows in one way. While exhaling, the first valve closes so as to avoid water flowing into the snorkel. Thus when the user float above the water and breathing in, fresh and dry air enters the snorkel for user to take a breath.

BRIEF DESCRIPTION OF THE DRAWINGS

FIG. 9 is a cross-sectional view showing air flow while breathing in;

DETAILED DESCRIPTION OF THE PREFERRED EMBODIMENT

Figure 1:
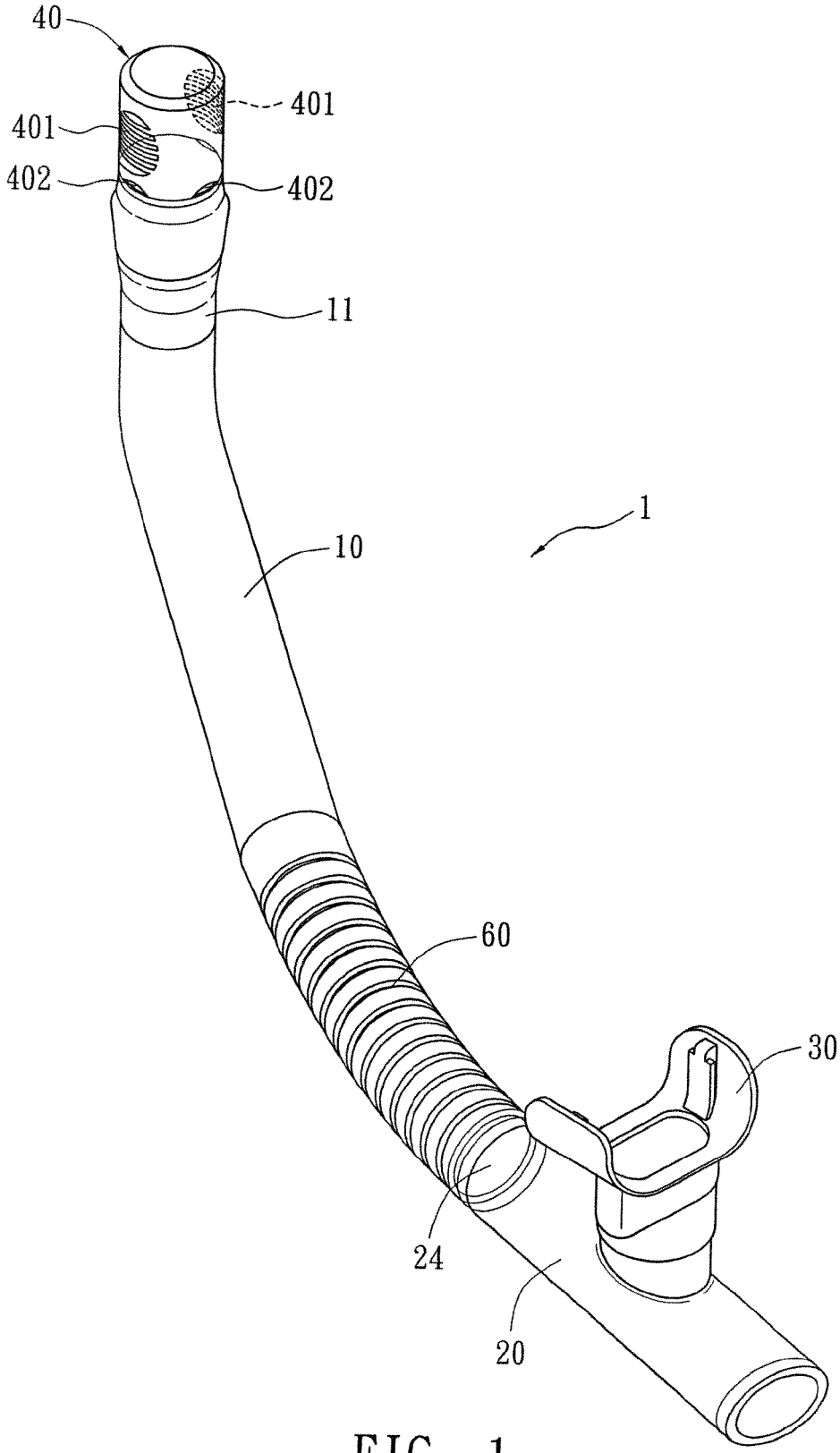
FIG. 1 is a perspective view of an embodiment according to the present invention.
Figure 2:
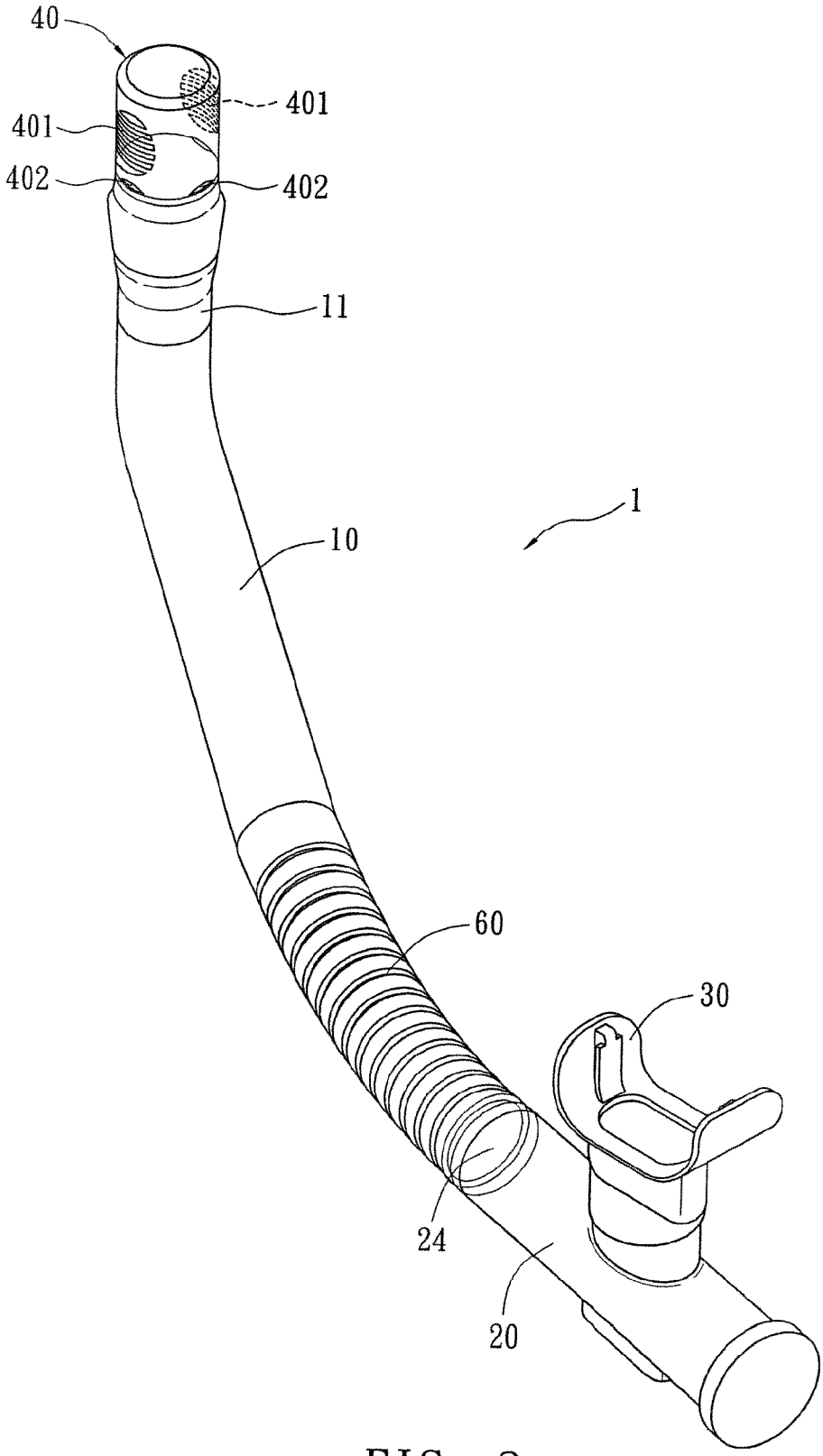
FIG. 2 is a perspective view of another embodiment according to the present invention.
Figure 3:
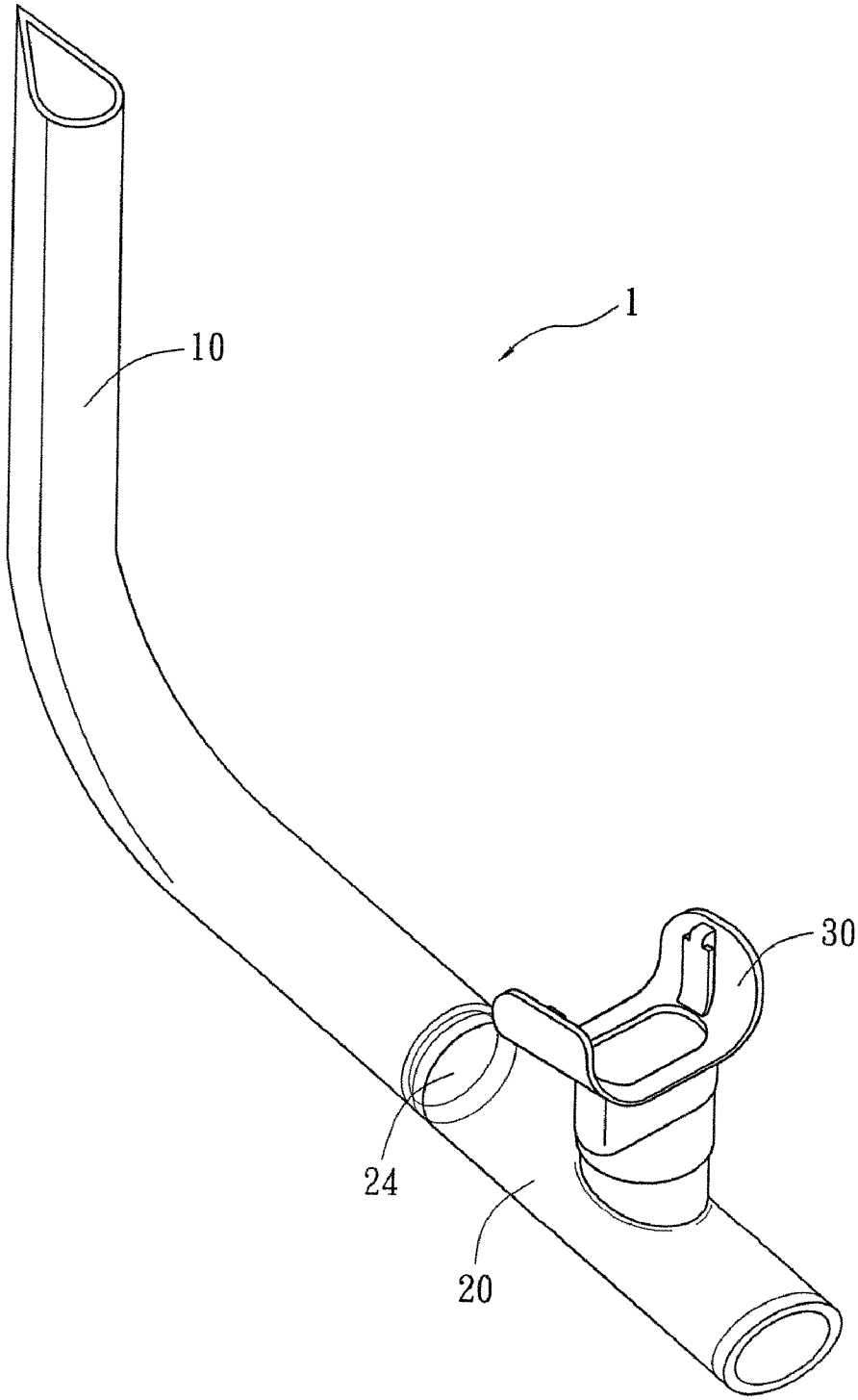
FIG. 3 is a perspective view of a further embodiment according to the present invention.
Figure 4:
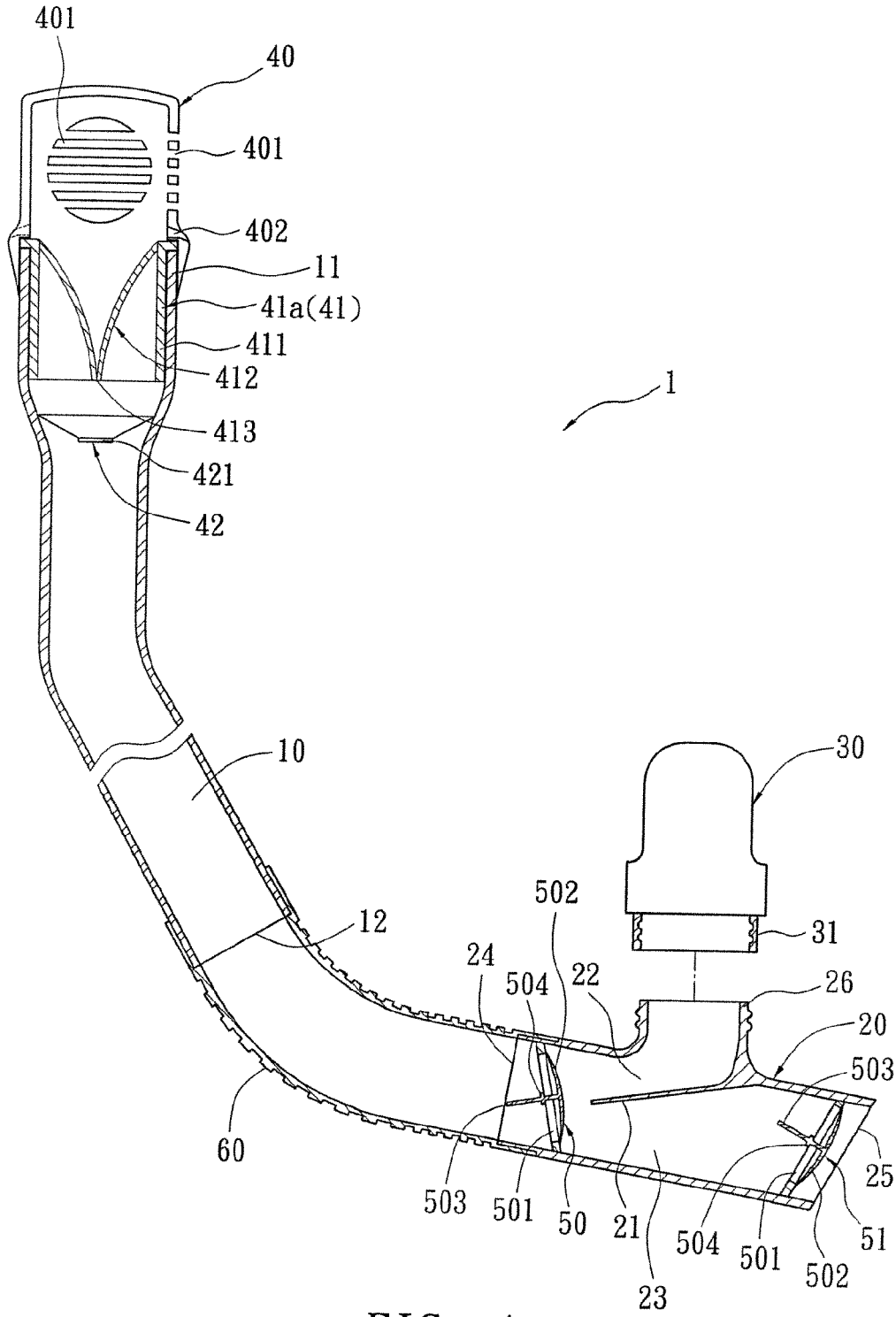
FIG. 4 is a frontal cross-sectional view of the embodiment in FIG. 1.

Refer from FIG. 1 tot FIG. 4, a snorkel 1 applied to floating or skin diving on the sea according to the present invention consists of an inlet tube 10, a mouthpiece chamber 20 and a mouthpiece 30. The inlet tube 10 is a tube structure and a comber impermeable cap 40 that breaks waves is arranged on a top end 11 of the inlet tube 10 so as to make fresh air flow into the snorkel through the inlet tube 10 and prevent water from flowing into the inlet tube 10. A bottom end 12 of the inlet tube 10 is directly (as shown in FIG. 3) or by a flexible soft tube 60 (as shown in FIG. 1, FIG. 2 & FIG. 4) sleeved on an inlet end 24 of the mouthpiece chamber 20. The comber impermeable cap 40 is a cap disposed with a plurality comber hole 401 for air inlet on certain positions and at least one overspill hole 402 is arranged on a lower part thereof. The shape of the comber impermeable cap 40 is not limited and it can be a cap, a tube, a ball or a mask (not shown in figure) so as to increase interests or significance. Thus the user's (diver's) position is easy to be found.

Figure 5A:
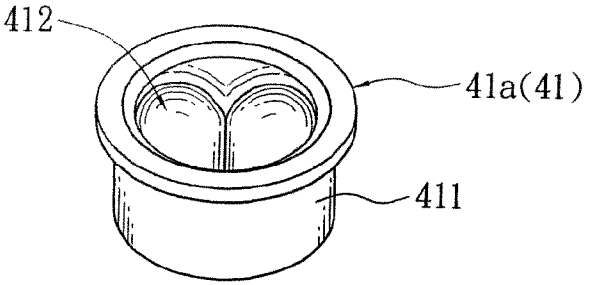
FIG. 5A is a perspective view of a duck-billed one-way valve according to the present invention.
Figure 5B:
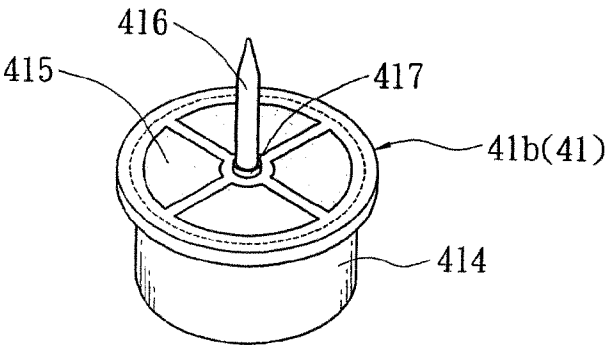
FIG. 5B is a perspective view of a diaphragm one-way valve according to the present invention.
Figure 5C:
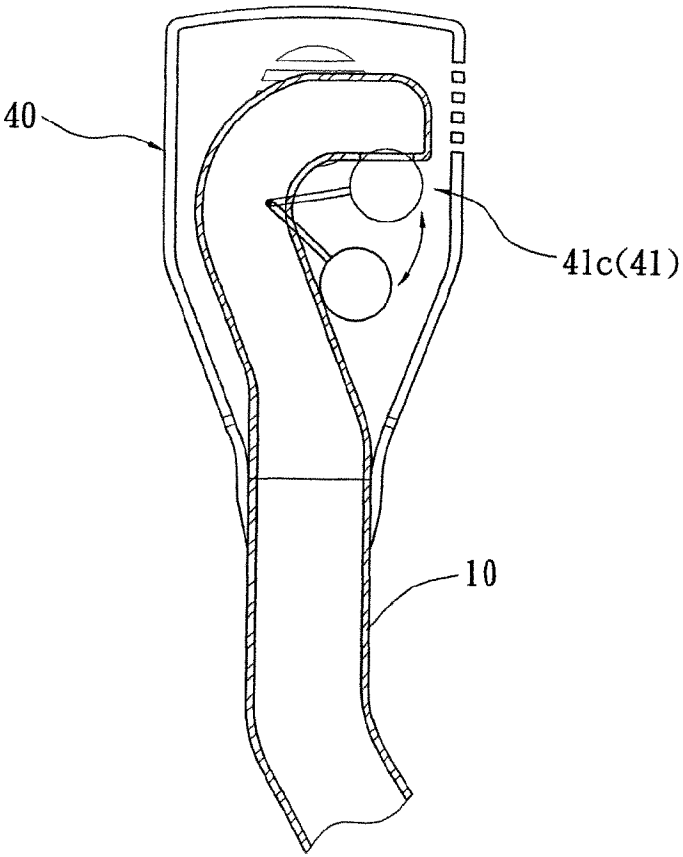
FIG. 5C is a perspective view of a float type one-way valve according to the present invention.

The comber impermeable cap 40 is further disposed with a one-way first valve 41 on an inner side thereof. As shown in FIG. 4, or the one-way first valve 41 is arranged on the top end 11 of the inlet tube 10 or on the comber impermeable cap 40 that connects with the top end 11 of the inlet tube 10. The one-way first valve 41 that offers flow/gas in one direction an there is no restriction on its structure. For example, refer to FIG. 4 & FIG. 5A, the one-way first valve 41 is a duck-billed one-way valve 41*a* that is formed by a valve 411 disposed with at least one duck-billed piece 412 therein. The duck-billed piece 412 closes or opens due to pressure drop between inner/outer side of the snorkel 1. The duck-billed piece 412 opens while breathing in and the duck-billed piece 412 closes automatically without breathing so as to prevent water from flowing into the snorkel 1 and ensure fresh air enters into the snorkel for users to breath. Refer to FIG. 5B, or the one-way first valve 41 is a diaphragm one-way valve 41*b* having a valve 414. A top surface of the valve 414 is an opening covered by an umbrella-shaped membrane 415 whose thickness of center is larger than that of surroundings. A one-tailed post 416 and a positioning ring 417 are arranged on bottom of the valve 414 for fastening the membrane 415 therein. As shown in FIG. 5C, the one-way first valve 41 can be a float type one-way valve 41*c*. The above mentioned duck-billed one-way valve 41*a*, the diaphragm one-way valve 41*b* and the float type one-way valve 41*c* are all one way valves.

A water dispersion base 42 is further arranged under the one-way first valve 41. The water dispersion base 42 includes a disc surface 421 whose diameter is smaller than that of the inlet tube 10 so that residual water on a duck bill opening 413 flows down, touches the disc surface 421, spills on the wall of the inlet tube 10 and flows downwards along the wall. Thus the water on the duck bill opening 413 will not be inhaled by the user when the user breaths in so as to increase safety of the user.

The mouthpiece chamber 20 is a chamber disposed with a baffle that extends from bottom of an opening end 26 of the mouthpiece chamber 20 so as to form an upper chamber 22 and a lower chamber 23 and guides water on the baffle 21 to flow downwards. One end of the mouthpiece chamber 20 is an inlet end 24 that connects with the inlet tube 10 while the other end of the mouthpiece chamber 20 is an outlet end 25 for exhausting gas or water. A round opening end 26 is arranged on top surface of the mouthpiece chamber to be assembled with the mouthpiece. A round opening end 26 is arranged on top surface of the mouthpiece chamber 20 to be assembled with a lower part 31 of the mouthpiece 30. Moreover, the mouthpiece chamber 20 can be disposed on the inlet tube 10 for various activities such as the inlet tube 10 for floating/snorkeling in FIG. 1 & FIG. 2 or the inlet tube 10 for speed swimmers in FIG. 3.

Figure 7:
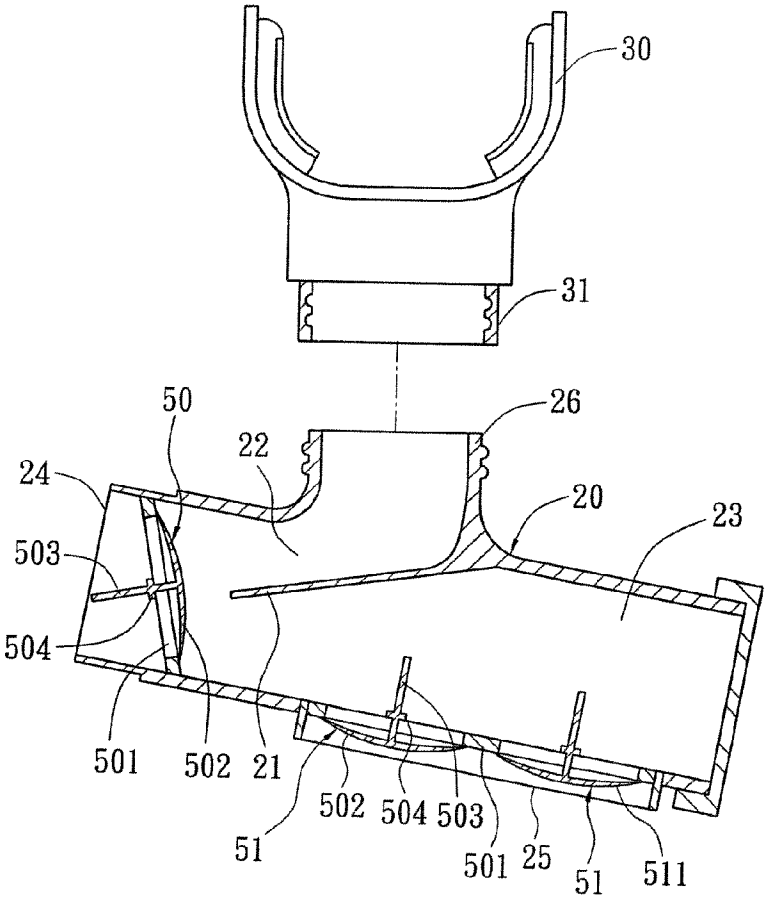
FIG. 7 is a partial cross-sectional view of another embodiment of a mouthpiece chamber according to the present invention.
Figure 6:
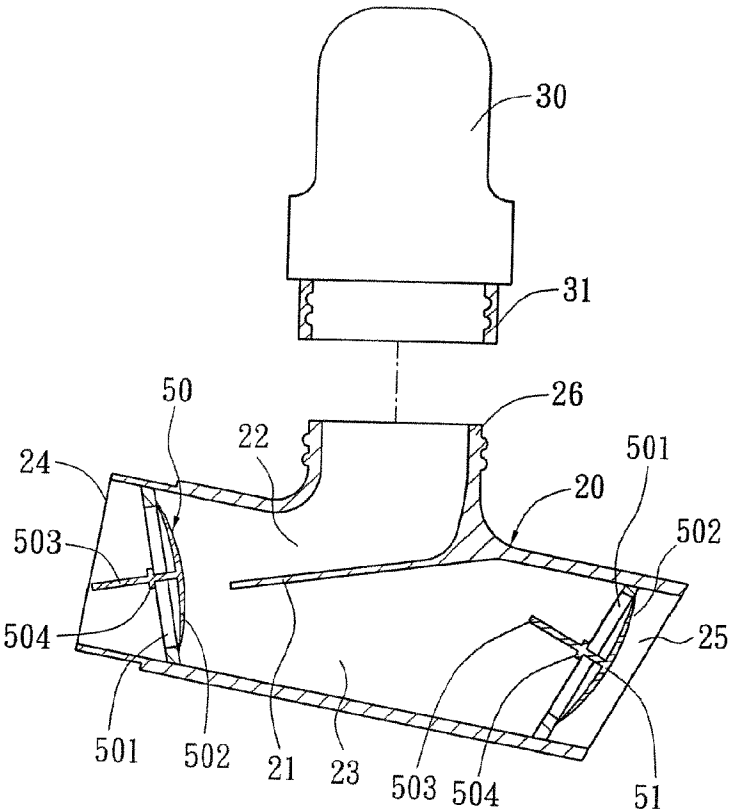
FIG. 6 is a partial cross-sectional view of an embodiment of a mouthpiece chamber according to the present invention.
Figure 8:
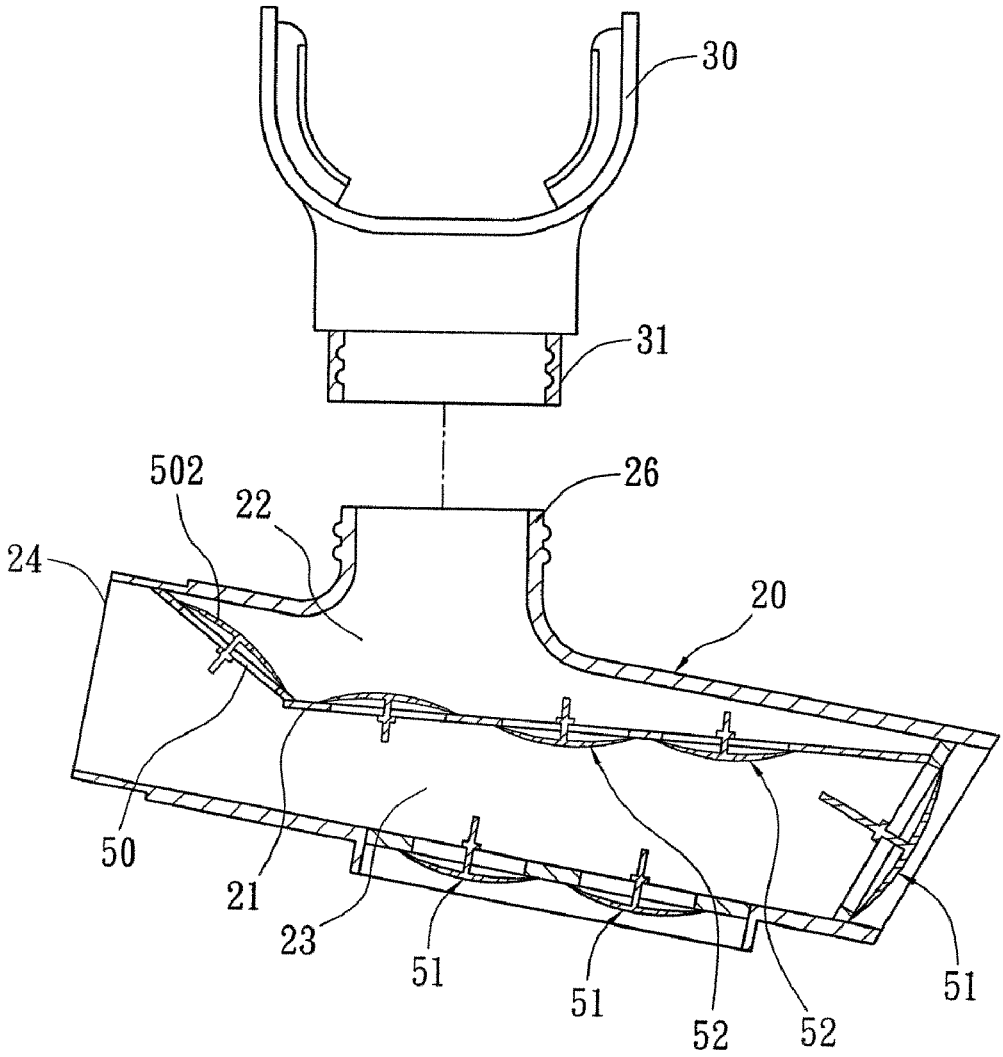
FIG. 8 is a partial cross-sectional view of a further embodiment of a mouthpiece chamber according to the present invention.

As shown in FIG. 6 & FIG. 7, a one-way second valve 50 inclining to the left side is arranged on an inner side of the inlet end 24 of the mouthpiece chamber 20, opposite to the mouthpiece chamber 20 or the upper mouthpiece chamber 22 (shown in FIG. 8) so that air flow only enters the mouthpiece chamber 20 or the upper mouthpiece chamber 22 in one direction. Refer to FIG. 8, the one-way second valve 50 is arranged near the opening end of the upper mouthpiece chamber 22 and connected with the baffle 21. Or the one-way second valve 50 is arranged on the baffle 21 so as to separate the upper chamber 22 and the lower chamber 23. Thus air flow only enters the upper chamber 22 through the one-way second valve 50.

At least one one-way third valve 51 is arranged on an inner side of the outlet end 25 of the mouthpiece chamber 20 so that air (or water in the mouthpiece chamber 20) can be exhausted from the mouthpiece chamber 20 in one direction. There is no restriction on the position and the number of the one-way third valve 51. Refer to FIG. 6, there is one one-way third valve 51 inclining toward the right side. Refer to FIG. 7, there are two one-way third valves 51 arranged on bottom side of the mouthpiece chamber 20 and facing downwards. Or as shown in FIG. 8, there is one one-way third valve 51 inclining toward the right side and two one-way third valves 51 facing downwards and on bottom side of the mouthpiece chamber 20. Refer to FIG. 8, at least one one-way fourth valve 52 is disposed on the baffle 21 and there are three one-way fourth valves 52. While breathing in, air flows through the inlet end 24, lifts a membrane 502 of the second valve 50 and enters the upper chamber 22 of the mouthpiece chamber 20 in one direction for users to breath. While breathing out, the waste air flows in one direction through the one-way fourth valve 52, enters the lower chamber 23, and exhausting through the third valve 51.

The one-way second valve 50, third valve 51 and the fourth valve 52 are diaphragm one-way valves formed by a valve 501 with an opening on the center thereof and around the opening is a hollow structure. The valve 501 is disposed with an umbrella-shaped membrane 502 whose thickness of center is larger than that of surroundings therein. A one-tailed post 503 is arranged and inserted through the opening on the center of the valve 501. And a positioning ring 504 disposed on certain position of the one-tailed post 503 for fastening the membrane 502 in the opening on the center of the valve 501.

The upper part of the mouthpiece 30 is a structure that matches shape of people's mouth while the lower part 31 thereof is a round tube structure being sleeved with a round opening end 26 of the mouthpiece chamber 20. The mouthpiece 30 can rotate 360 degrees horizontally so as to meet users requirements. Moreover, refer to FIG. 9 & FIG. 10, the contact area between the lower part of the mouthpiece 30 and the opening end 26 of the mouthpiece chamber 20 can be designed to be with projecting and concave rings so as to make them fasten with each other more firmly.

Figure 9:
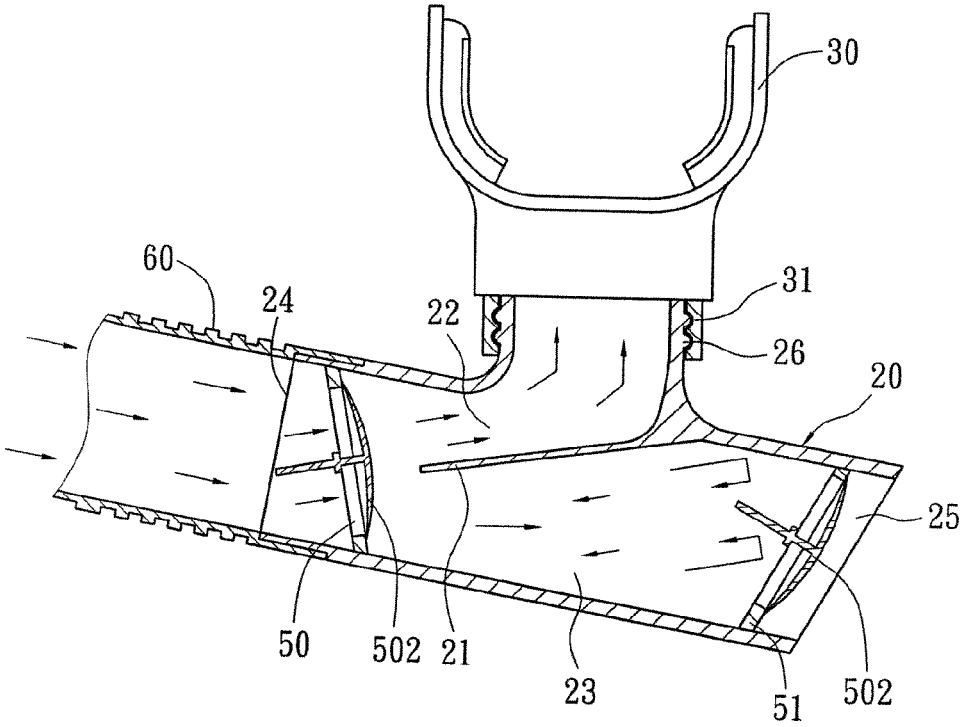

Refer to FIG. 9, when the swimmer breaths in, fresh air from external environment passes through the flexible soft tube 60, lifts the membrane 501 of the second valve 50, and enters the mouthpiece chamber 20, as arrows point. The inclining structure of the second valve 50 and the baffle 21 make the swimmer breaths in more easily and fast.

Figure 10:
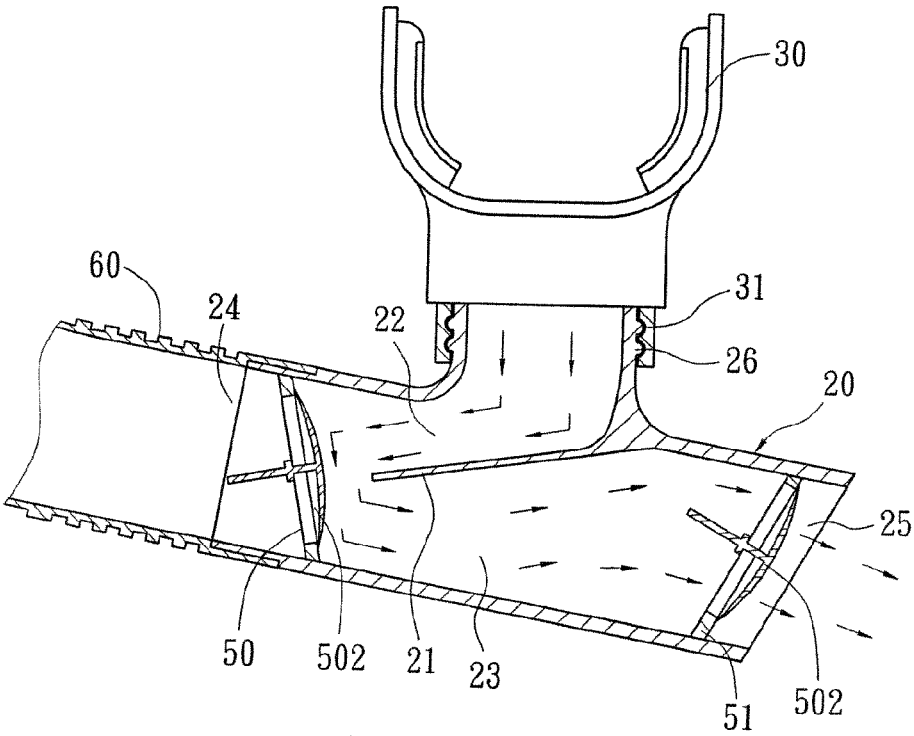
FIG. 10 is a cross-sectional view showing air flow while breathing out.

Refer to FIG. 10, when the swimmer breaths out, the waste air is unable flowing through the second valve 50 into the flexible soft tube 60 and mixing with fresh air while it's exhausted through the upper chamber 22, the lower chamber and the third valve 51, as arrows point. Moreover, when external water enters into the mouthpiece chamber 20 and accumulates in the lower chamber 23, pressure generated from exhalation of the swimmer makes the membrane 511 of the third valve 51 open quickly so as to exhaust water.

Figure 11:
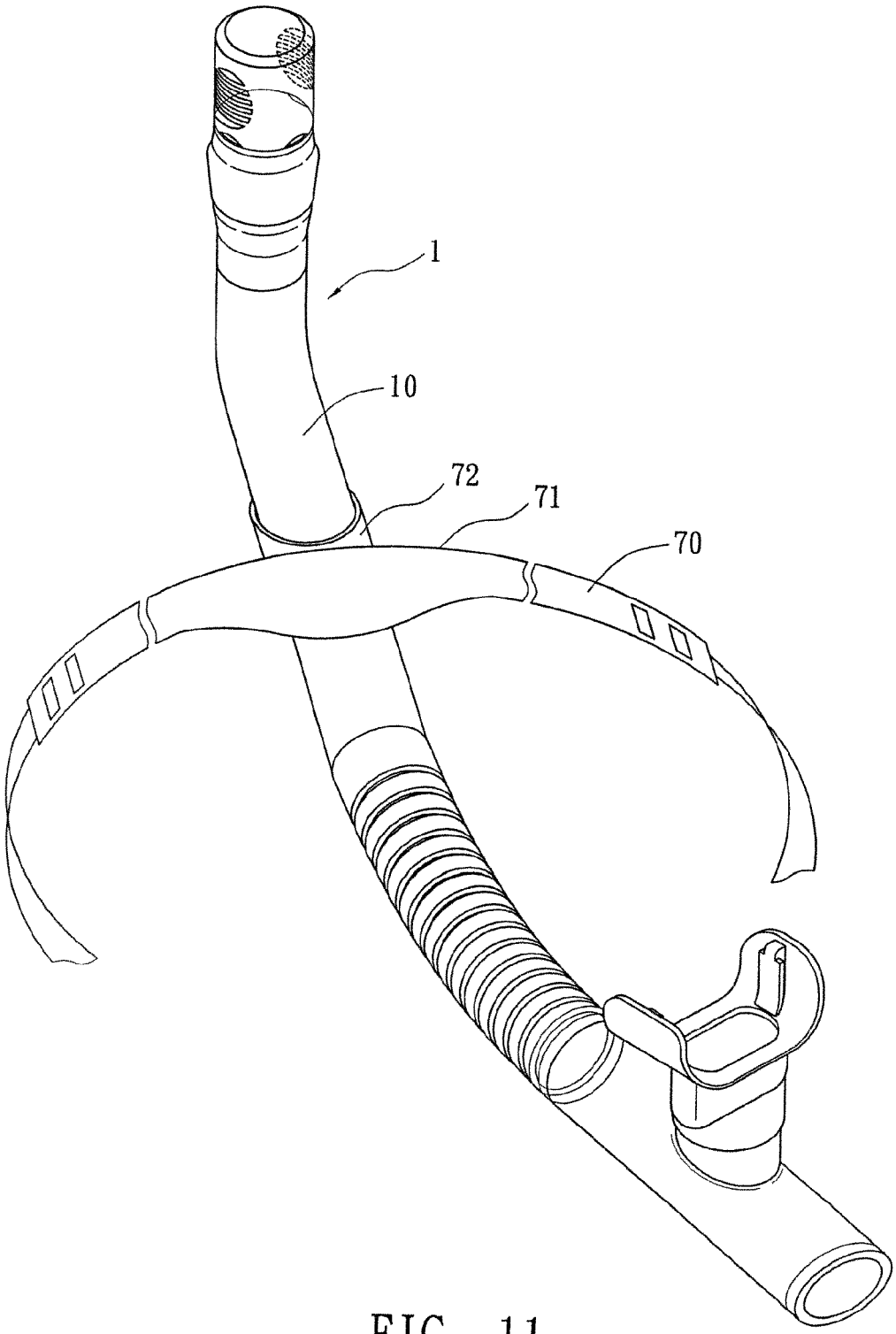
FIG. 11 is a use status showing an embodiment of the present invention assembled with a supporting belt.

Refer to FIG. 11, the inlet tube 10 of the snorkel 1 is further disposed with a supporting belt 70 so that the swimmer can wear the snorkel 1 on the head and the snorkel 1 is between two eyes vertically. The supporting belt 70 is formed by puffy glue covered with a hydrophilic elastic belt. A self stick reclosable fasteners 72 arranged on a certain position of the supporting belt 70 is used to fasten and locate the inlet tube 10 on the supporting belt 70. While not use, the supporting belt 70 is folded and convenient for storage without occupying space.

Figure 12:
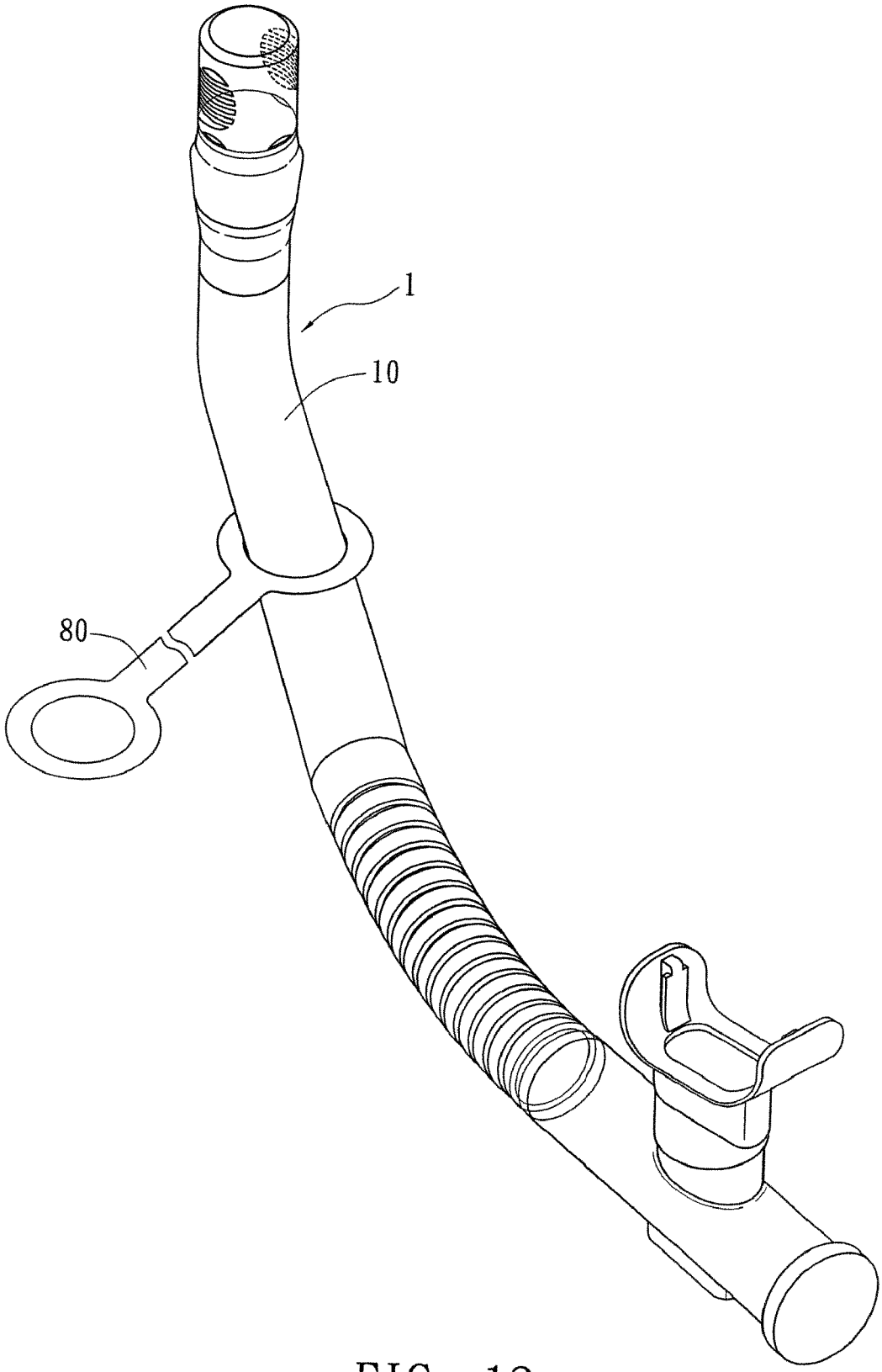
FIG. 12 is a use status showing an embodiment of the present invention assembled with a ring fastener.

Refer to FIG. 12, the inlet tube 10 of the snorkel 1 is further arranged with a ring fastener 80 for the swimmer to fasten the snorkel 1. There is no restriction on material of the ring fastener 80 and it can be a soft or a hard ring. One end of the ring fastener 80 is around the inlet tube 10 while the other end thereof is fastened on one side of a mask strap (not shown in figure) so that the snorkel 1 stands beside the swimmer's face.

In summary, the snorkel 1 according to the present invention prevents water from flowing into the inlet tube 10 while fresh air can enter the snorkel 1 so as to make air in the inlet tube 10 keep fresh for the user to take a breath. And the exhaled waste air is unable to enter the inlet tube 10 and is exhausted through the third valve 51 so as to prevent carbon dioxide from accumulating in the inlet tube 10. Thus when the swimmer swims fast and breaths quickly, the user will not have hypoxia or carbon dioxide intoxication caused by no fresh air entering into the lung and dead space occurs. Therefore, the snorkel 1 makes people breath easily without water inhalation or hypoxia and such snorkel 1 is with higher safety.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A snorkel for floating or skin diving comprising an inlet tube, a mouthpiece chamber and a mouthpiece, wherein the inlet tube is a tube whose bottom end is sleeved on an inlet end of the mouthpiece chamber;

the mouthpiece chamber is a chamber with the inlet end for connecting with the inlet tube on one end while an outlet end is arranged on an opposite end, corresponding to the inlet end; a baffle is arranged therein so as to form an upper chamber and a lower chamber; a round opening end is arranged on a top surface of the mouthpiece chamber for being sleeved on the mouthpiece; at least one one-way second valve is disposed on an inner side of the inlet end so as to make air flow into the mouthpiece chamber only in one direction and at least one one-way third valve is arranged on an inner side of the output end so that air or water in the mouthpiece chamber is released only in one direction;

the mouthpiece bit by an user's month having a lower part that is a round tube end being sleeved on the round opening end on the top surface of the mouthpiece chamber and is adjustable to be rotated horizontally into different angles; wherein in use, external air flows through the inlet tube, the second valve and enters into the mouthpiece chamber for user to breath in while exhaled waste air in the mouthpiece chamber is unable to enter the inlet tube and is discharged by the third valve in one direction; a little water in the mouthpiece chamber is also discharged through the third valve along with exhaling.

2. The device as claimed in claim 1, wherein the baffle extends from bottom of the opening end of the mouthpiece chamber and is integrated with the opening end.

3. The device as claimed in claim 1, wherein the one-way second valve is arranged on the opening end of the upper chamber and is connected with the baffle so that air flows into the upper chamber of the mouthpiece chamber in one direction while at least one one-way fourth valve is disposed on the baffle so as to make air flow out only through the upper chamber.

4. The device as claimed in claim 1, wherein an impermeable cap is arranged on a top end of the inlet tube so as to make fresh air flow into the snorkel through the inlet tube and prevent water from flowing into the inlet tube while the impermeable cap is a cap with a plurality of comber holes for air inlet surroundingly.

5. The device as claimed in claim 4, wherein at least one an overspill hole is arranged under the impermeable cap.

6. The device as claimed in claim 1, wherein at least one one-way first valve is arranged on a top end of the inlet tube.

7. The device as claimed in claim 1, wherein the second valve is arranged inclining toward the left side.

8. The device as claimed in claim 1, wherein the third valve is arranged inclining toward the right side.

* * * * *